US008308258B2

(12) United States Patent
Iriguchi

(10) Patent No.: US 8,308,258 B2
(45) Date of Patent: Nov. 13, 2012

(54) LIQUID DROPLET JETTING APPARATUS

(75) Inventor: Akira Iriguchi, Ichinomiya (JP)

(73) Assignee: Brother Kogyo Kabushiki Kaisha, Aichi-ken (JP)

( * ) Notice: Subject to any disclaimer, the term of this patent is extended or adjusted under 35 U.S.C. 154(b) by 285 days.

(21) Appl. No.: 12/728,640

(22) Filed: Mar. 22, 2010

(65) Prior Publication Data

US 2010/0328378 A1 Dec. 30, 2010

(30) Foreign Application Priority Data

Jun. 29, 2009 (JP) ..... 2009-153599

(51) Int. Cl.
*B41J 29/38* (2006.01)

(52) U.S. Cl. ..... 347/10; 347/11

(58) Field of Classification Search ..... None
See application file for complete search history.

(56) References Cited

U.S. PATENT DOCUMENTS

2007/0146403 A1* 6/2007 Sayama et al. ..... 347/10

FOREIGN PATENT DOCUMENTS

JP 2002-86766 3/2002
JP 2007-98820 4/2007

* cited by examiner

*Primary Examiner* — Geoffrey Mruk
(74) *Attorney, Agent, or Firm* — Scully, Scott, Murphy & Presser, PC

(57) ABSTRACT

A liquid droplet jetting apparatus which jets liquid droplets includes: a liquid droplet jetting head which has a nozzle for jetting the liquid droplets; and a jetting controller which controls the liquid droplet jetting head to jet the liquid droplets from the nozzles by supplying the liquid droplet jetting head with a driving signal having a predetermined drive waveform in each of continuing driving periods, and which includes: a driving waveform selecting section which selects, with respect to each of the continuing driving periods, a driving waveform from a plurality of driving waveforms each having a wavelength which is same as a length of one driving period; and a driving waveform shifting section which shifts the driving waveform selected by the driving waveform selecting section.

8 Claims, 12 Drawing Sheets

| | SHIFT STATUS | DRIVE PERIOD (DRIVE IN THE ORDER OF A TO G) | | | | | | |
|---|---|---|---|---|---|---|---|---|
| | | A | B | C | D | E | F | G |
| No. 1 | BEFORE | — | — | L | — | L | — | — |
| | AFTER | — | L | - | L | — | — | — |
| No. 2 | BEFORE | — | — | L | L | M | — | — |
| | AFTER | — | L | L | — | M | — | — |
| No. 3 | BEFORE | — | — | L | M | L | L | — |
| | AFTER | — | L | — | L | L | — | — |
| No. 4 | BEFORE | — | — | M | M | M | L | — |
| | AFTER | — | — | M | M | L | — | — |
| No. 5 | BEFORE | — | — | L | L | S | — | — |
| | AFTER | — | L | L | — | S | — | — |
| No. 6 | BEFORE | — | — | M | M | S | — | — |
| | AFTER | — | — | M | M | S | — | — |

L: LARGE DROP WAVEFORM
M: MEDIUM DROP WAVEFORM
S: SMALL DROP WAVEFORM
—: NON-JET WAVEFORM

Fig. 9

| | SHIFT STATUS | DRIVE PERIOD (DRIVE IN THE ORDER OF A TO G) | | | | | | |
|---|---|---|---|---|---|---|---|---|
| | | A | B | C | D | E | F | G |
| No. 1 | BEFORE | — | — | L | — | L | — | — |
| | AFTER | — | L | - | L | — | — | — |
| No. 2 | BEFORE | — | — | L | L | M | — | — |
| | AFTER | — | L | L | — | M | — | — |
| No. 3 | BEFORE | — | — | L | M | L | L | — |
| | AFTER | — | L | — | L | L | — | — |
| No. 4 | BEFORE | — | — | M | M | M | L | — |
| | AFTER | — | — | M | M | L | — | — |
| No. 5 | BEFORE | — | — | L | L | S | — | — |
| | AFTER | — | L | L | — | S | — | — |
| No. 6 | BEFORE | — | — | M | M | S | — | — |
| | AFTER | — | — | M | M | S | — | — |

L: LARGE DROP WAVEFORM
M: MEDIUM DROP WAVEFORM
S: SMALL DROP WAVEFORM
—: NON-JET WAVEFORM

LIQUID DROPLET JETTING APPARATUS

CROSS REFERENCE TO RELATED APPLICATION

The present application claims priority from Japanese Patent Application No. 2009-153599, filed on Jun. 29, 2009, the disclosure of which is incorporated herein by reference in its entirety.

BACKGROUND OF THE INVENTION

1. Field of the Invention

The present invention relates to a liquid droplet jetting apparatus which jets liquid droplets.

2. Description of the Related Art

Conventionally, there are known ink jetprinters which jet ink droplets toward a recording medium such as a sheet of paper and the like to record an image and the like. Among the ink-jet printers, there have been those configured to be capable of selectively forming a plurality of types of dots different in size on the recording medium (gradation printing) by changing jetting amount of the liquid droplets jetted from one nozzle within a predetermined period (driving period). For example, Japanese Patent Application Laid-Open No. 2002-86766 (paragraphs 0007 and 0008, and FIG. 11) describes an ink-jet printer which applies any one of three types of driving pulses different in pulse width from each other to the ink-jet head in each predetermined period so as to jet a liquid droplet corresponding in size to the applied driving pulse.

Japanese Patent Application Laid-Open No. 2002-86766 describes that the landing positions on the recording medium may be deviated because the jetting velocities are different according to the sizes of the liquid droplets jetted from the nozzle. In particular, it is described that since a small liquid droplet tends to become lower in velocity than a large liquid droplet, landing positions of the small liquid droplets are deviated. Therefore, as a method for solving this problem, it is disclosed that in jetting the small liquid droplet, the timing for applying the drive pulse is advanced a little so as to apply the drive pulse for the small liquid droplet from the middle of the last period.

However, when the liquid droplet landing position are greatly deviated, little effect can be expected even if the drive pulse application timing is advanced to such an extent as only to overlap the last driving period.

SUMMARY OF THE INVENTION

Further, in Japanese Patent Application Laid-Open No. 2002-86766, it is described that as amount of a liquid droplet becomes smaller, the jetting velocity becomes lower. However, as will be, described below, there is also a case that as amount of a liquid droplet becomes greater, the jetting velocity becomes lower. In this case, a large dot formed on the recording medium is deviated from a small dot more than the former case. Hence, in comparison with the case that small dots deviate as described in Japanese Patent Application Laid-Open No. 2002-86766, the positional deviation becomes more conspicuous, thereby greatly lowering the print quality. Therefore, it is desirable to make it a top priority to resolve such landing position deviation of the large dots.

The following may be regarded as an example of a case that as amount of a liquid droplet which is jetted becomes greater, the jetting velocity becomes lower. As shown in FIG. 5D in accordance with an embodiment, the inventor adopts a method in which a plurality of drive pulses P are applied continuously to the ink-jet head within one driving period to consecutively jet the liquid droplets from a nozzle by the plurality of drive pulses P, so that the total amount of the liquid droplets jetted from the nozzle within one driving period increases.

As shown in FIGS. 5B and 5C, when the number of the drive pulses P is small within one driving period (jetting amount of the liquid droplets is small), there is little restriction of the pulse width. Therefore, it is possible to determine the pulse width of each of the drive pulses P in a comparatively free manner. As a result, it is possible to approach an ideal pulse width which effectively applies a high energy to the ink so as to achieve a high liquid droplet velocity. However, as shown in FIG. 5D, when the number of the drive pulses P is large (jetting amount of the liquid droplets is large), there is a time restriction that these drive pulses P have to be put within one driving period. Consequently, the pulse width of each of the drive pulses P has to be made considerably narrower than the ideal pulse width. In this manner, a larger number of the drive pulses P result in a lower degree of freedom in the pulse width. Accordingly, the jetting velocity of each of the liquid droplets jetted by one of drive pulses P becomes lower. Therefore, landing positions of the liquid droplets jetted by the drive pulses P are greatly deviated from each other. This causes a greater positional deviation of the large dot formed by the plurality of liquid droplets as a whole.

If length of one driving period is prolonged, the time restriction on the pulse width of each of the drive pulses P is eased even when there are many drive pulses P. Accordingly, it is possible to restrain each of the liquid droplets from decreasing in velocity. However, as the length of each of driving periods is prolonged, total printing velocity is lowered. Contrarily, when a short driving period is set to raise the printing, velocity, as the number of the drive pulses P within one driving period is increased in order to form a large dot, the more the restriction is brought on the pulse width of each of the drive pulses P. As a result, the large dot deviates in position to a considerable extent (for example, one dot or more).

Accordingly, an object of the present invention is to provide a liquid droplet jetting apparatus capable of restraining a liquid droplet from deviation of landing position when there are many drive pulses applied and much liquid droplet amount jetted within one driving period.

According to a first aspect of the present invention, there is provided a liquid droplet jetting apparatus which jets liquid droplets, the apparatus including: a liquid droplet jetting head which has a nozzle for jetting the liquid droplets; and a jetting controller which controls the liquid droplet jetting head to jet the liquid droplets from the nozzle by supplying the liquid droplet jetting head with a driving signal having a predetermined drive waveform in each of continuing driving periods, and which includes: a driving waveform selecting section which selects, with respect to each of the continuing driving periods, a driving waveform from a plurality of driving waveforms each having a wavelength which is same as a length of one driving period; and a driving waveform shifting section which shifts the driving waveform selected by the driving waveform selecting section, and the driving waveforms have at least three types of driving waveforms which include a first driving waveform having at least one driving pulse for jetting the liquid droplets, a second driving waveform having driving pulses more than the first driving waveform for jetting the liquid droplets more than the first driving waveform, and a non-jetting waveform having no drive pulse, and when the driving waveform selecting section selects the second driving waveform with respect to one driving period among the continuing driving periods, the driving waveform shifting section shifts the second driving waveform from the one driving period to another driving period which is before the one driving period.

The driving waveform selecting section selects a drive waveform of the drive signal supplied by the jetting controller to the liquid droplet jetting head with respect to each of the continuing driving periods. More specifically, the driving waveform selecting section selects a waveform from at least three types of waveforms of a first driving waveform, a second driving waveform, and a non-jet waveform. When the non-jet waveform is selected with respect to a driving period, the liquid droplet jetting head does not jet the liquid droplet from the nozzle. When the first driving waveform is selected with respect to a driving period, the liquid droplet jetting head jets at least one liquid droplet corresponding to the drive pulse(s) from the nozzle. Furthermore, when the second driving waveform is selected, the liquid droplet jetting head jets the liquid droplets which correspond respectively to the plurality of drive pulses and which are more in quantity in comparison with the first driving waveform from the nozzle. That is, during the driving period with respect to which the second driving waveform is selected, jetting amount of the liquid droplet becomes greater than that of driving period with respect to which the first driving waveform is selected.

Here, as described before, when the second driving waveform having more drive pulses than the first driving waveform within one driving period is selected, the jetting velocities of the plurality of liquid droplets jetted according to the plurality of drive pulses respectively become lower than those when the first driving waveform is selected, and thereby the landing position deviates greatly. Therefore, according the present invention, when the second driving waveform is selected with respect to a driving period, the second driving waveform is shifted one period ahead or more of the driving period. Therefore, it is possible to reduce the deviation of the liquid droplet landing position when the second driving waveform which has more drive pulses and for jetting much liquid droplet is selected.

BRIEF DESCRIPTION OF THE DRAWINGS

FIG. 9 is a diagram showing examples of shifting large drop waveforms;

DESCRIPTION OF THE PREFERRED EMBODIMENT

Hereinafter, a preferred embodiment of the present invention will be described. The embodiment is an example of applying the present invention to an ink-jet printer having an ink-jet head which jets ink droplets to a recording paper.

Figure 1:
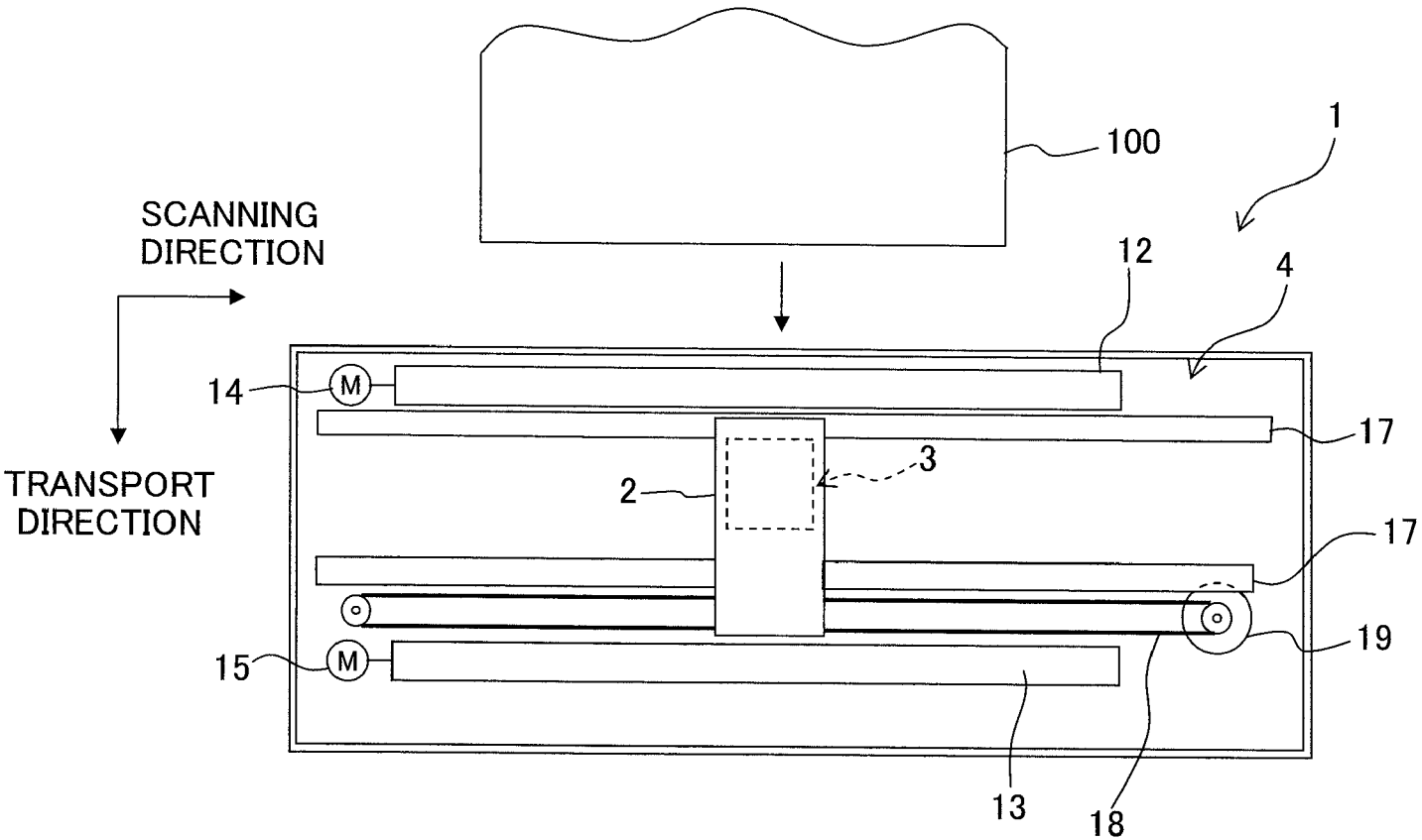
FIG. 1 is a plan view showing a schematic construction of a printer as an example of the liquid droplet jetting apparatus according to an embodiment of the present invention.

First, an explanation will be given with respect to a schematic construction of an ink-jet printer 1 (liquid droplet jetting apparatus) in accordance with the embodiment. As shown in FIG. 1, the printer 1 includes a carriage 2 (moving mechanism) which is constructed to be movable in a reciprocating manner in a predetermined scanning direction (a left-right direction of FIG. 1), an ink-jet head 3 (liquid droplet jetting head) which is provided on the carriage 2, a transport mechanism 4 for transporting a recording paper 100 in a transport direction (toward the lower portion of FIG. 1) which is perpendicular to the scanning direction, and the like.

The carriage 2 is constructed to be movable in a reciprocating manner along two guide axes 17 extending parallel to the scanning direction (the left-right direction of FIG. 1). Further, an endless belt 18 is connected to the carriage 2 such that the carriage 2 is moved in the scanning direction in company with the traveling of the endless belt 18 when the endless belt 18 is driven to travel by a carriage drive motor 19.

On the carriage 2, the ink-jet head 3 is provided. The ink-jet head 3 is provided with a plurality of nozzles 30 (see FIGS. 2 to 4) on the under surface thereof (the surface located at the back side of the sheet surface of FIG. 1). The ink-jet head 3 jets ink(s) supplied by an ink cartridge (not shown) from the plurality of nozzles 30 to the recording paper transported by the transport mechanism 4 in the downward direction of FIG. 1 (transport direction).

The transport mechanism 4 has a paper feeding roller 12 which is arranged on the upstream side with respect to the ink-jet head 3 in the transport direction, and a paper discharging roller 13 which is arranged on the downstream side with respect to the ink-jet head 3 in the transport direction. The paper feeding roller 12 and the paper discharging roller 13 are rotationally driven by a paper feeding motor 14 and a paper discharging motor 15, respectively. Further, the transport mechanism 4 transports the recording paper 100 from the upside of FIG. 1 toward the ink-jet head 3 by the paper feeding roller 12 while discharging the recording paper 100 on which images, characters, and the like are recorded by the ink-jet head 3 to the downside of FIG. 1 by the discharging roller 13.

Figure 2:
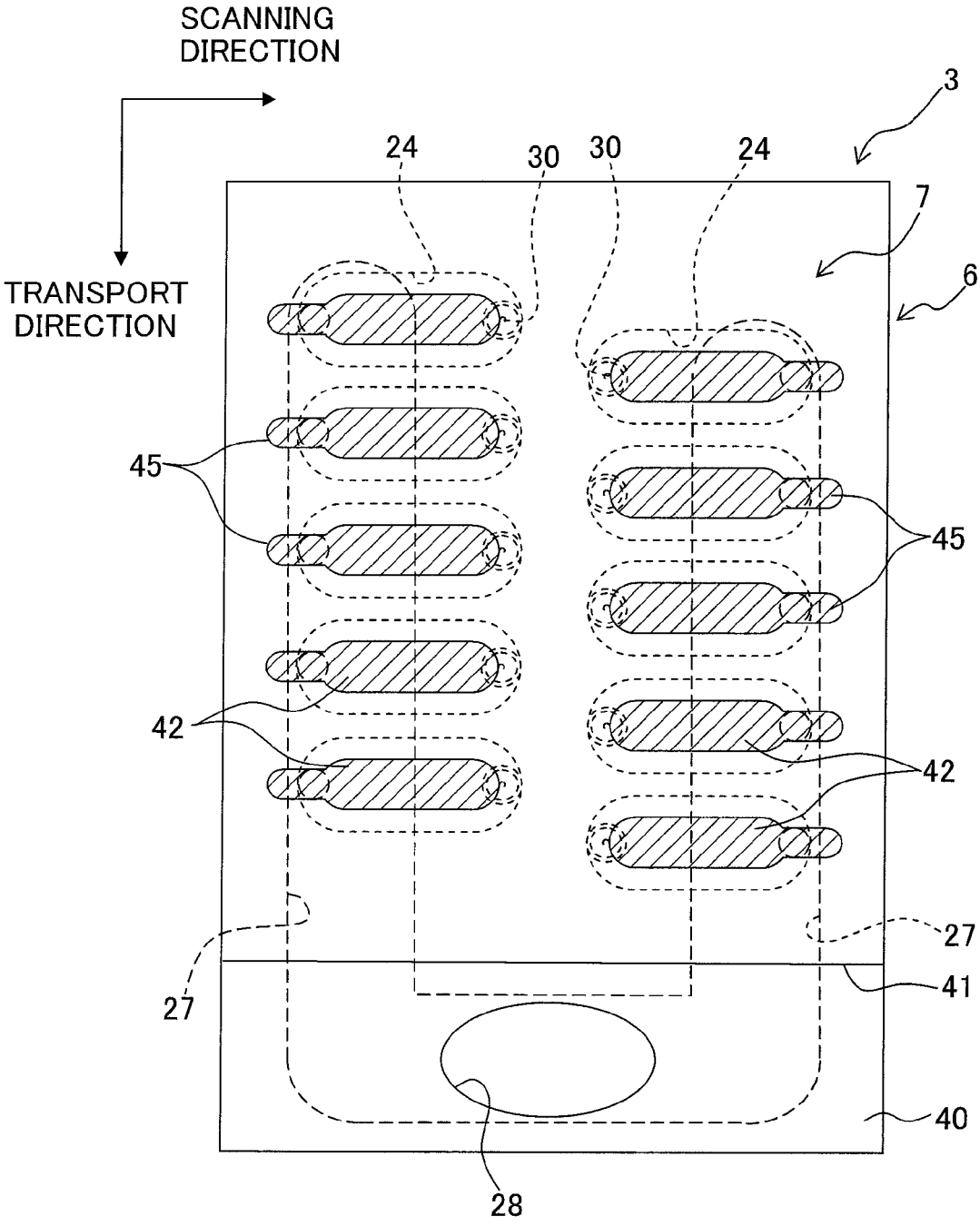
FIG. 2 is a plan view of an ink-jet head.
Figure 3:
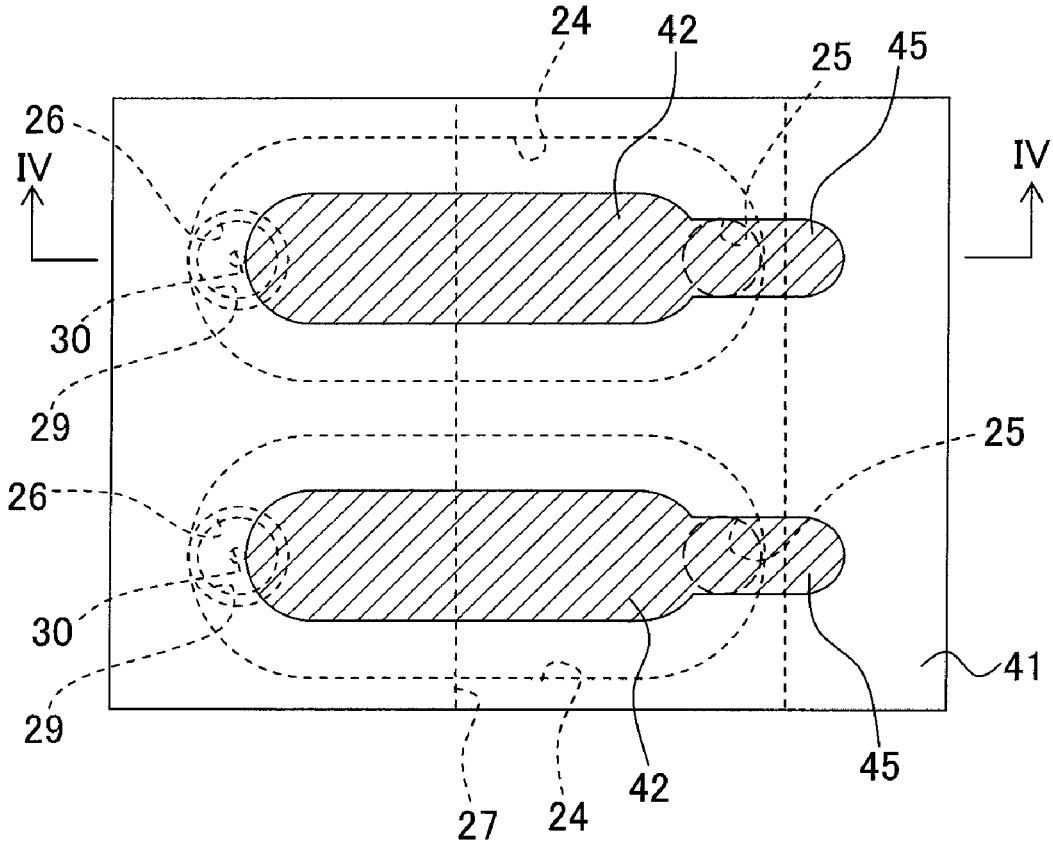
FIG. 3 is a partial enlarged view of FIG. 2.
Figure 4:
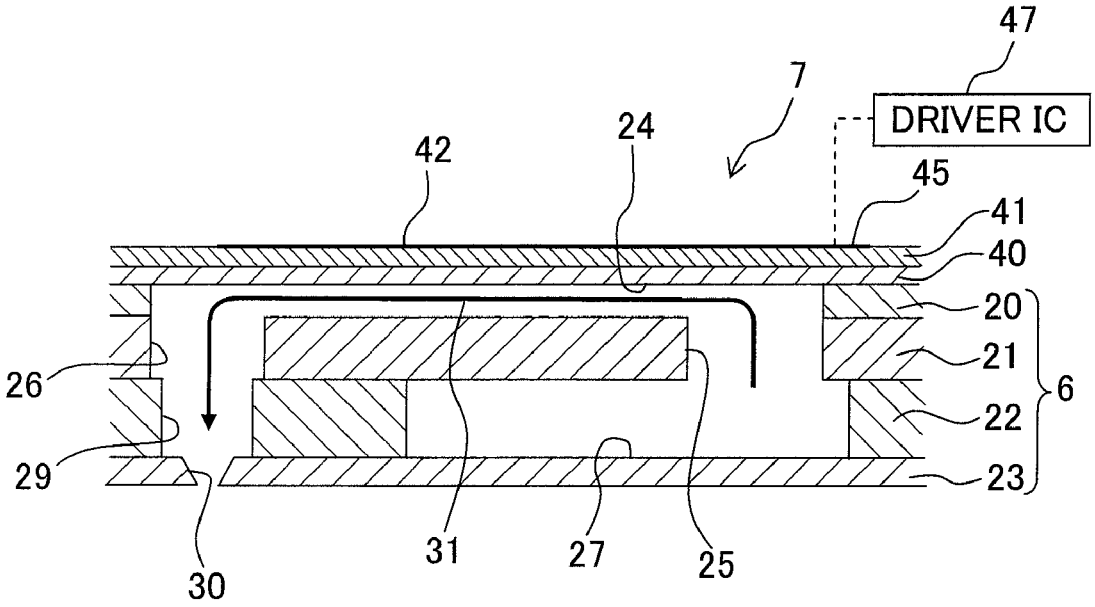
FIG. 4 is a cross-sectional view taken along the line IV-IV in FIG. 3.

Next, the ink-jet head 3 will be explained. As shown in FIGS. 2 to 4, the ink-jet head 3 has a flow passage unit 6 in which ink flow passages including nozzles 30 and pressure chambers 24 are formed, and a piezoelectric actuator unit 7 which applies a pressure to the ink(s) inside the pressure chambers 24.

First, the flow passage unit 6 will be explained. As shown in FIG. 4, the flow passage unit 6 includes a cavity plate 20, a base plate 21, a manifold plate 22, and a nozzle plate 23. These four plates 20 to 23 are joined together in a stacked state. Among them, the cavity plate 20, the base plate 21, and the manifold plate 22 are, in a plane view, approximately rectangular plates formed of a metallic material such as stainless steels, respectively. Therefore, in these three plates 20 to 22, ink flow passages such as manifolds 27 and the pressure chambers 24 which will be described hereinbelow may be easily formed by etching. Further, the nozzle plate 23 is formed of a high polymer synthetic-resin material such as polyimide, and joined on the under surface of the manifold plate 22 with an adhesive.

As shown in FIGS. 2 to 4, among the four plates 20 to 23, the uppermost positioned cavity plate 20 has a plurality of pressure chambers 24 which are aligned on the planar surface and formed with holes passing through the plate 20. Further, the plurality of pressure chambers 24 are aligned in two rows in a staggered manner in the transport direction (the up-down direction of FIG. 2). Further, as shown in FIG. 4, the plurality of pressure chambers 24 are covered by the base plate 21 and a vibration plate 40 which will be described hereinafter from downside and upside, respectively. Furthermore, each of the pressure chambers 24 has a shape of an approximate ellipse which is, in a plane view, elongated in the scanning direction (the left-right direction of FIG. 2).

As shown in FIGS. 3 and 4, communication holes 25 and 26 are formed in the base plate 21 at the positions which, in a plane view, overlap each of two end portions in the longitudinal direction of the pressure chamber 24, respectively. Further, in the manifold plate 22, two manifolds 27 extending in the transport direction are formed, in a plane view, so as to overlap the portions of the pressure chambers 24 aligned in two rows on the sides of the communication holes 25. These two manifolds 27 are in communication with an ink supply port 28 formed in an aftermentioned vibration plate 40 to supply an ink to the manifolds 27 through the ink supply port 28 from an ink tank (not shown). Further, a plurality of communication holes 29 are also formed to be in respective connection with the plurality of communication holes 26 in the manifold plate 22 at the positions which overlap with the end portions of the plurality of pressure chambers 24 on the opposite sides of the manifolds 27 in a plane view.

Further, a plurality of nozzles 30 are formed in the nozzle plate 23 at the positions which, in a plane view, respectively overlap the plurality of communication holes 29. As shown in FIG. 2, the plurality of nozzles 30 are arranged respectively to overlap the end portions of the plurality of pressure chambers 24 aligned in two rows in the transport direction on sides opposite to the manifolds 27.

Further, as shown in FIG. 4, the manifolds 27 communicate with the pressure chambers 24 via the communication holes 25, and the pressure chambers 24 further communicate with the nozzles 30 via the communication holes 26 and 29. In this manner, inside the flow passage unit 6, a plurality of individual ink flow passages 31 are formed from the manifolds 27 through the pressure cambers 24 to the nozzles 30.

Further, in FIG. 2, for the simplicity of explanation, only one flow passage structure (the manifolds 27, pressure chambers 24, nozzles 30, and the like) is illustrated in connection with one ink supply port 28. However, in reality, the ink-jet head 3 of the embodiment is a color ink-jet head which is provided with a plurality of such flow passage structures as shown in FIG. 2 arranged in the scanning direction, thereby being able to jet inks of a plurality of colors (four colors, for example: black, yellow, cyan, and magenta), respectively.

Next, the piezoelectric actuator unit 7 will be explained. As shown in FIGS. 2 to 4, the actuator unit 7 includes a vibration plate 40 which is arranged on the upper surface of the flow passage unit 6 (cavity plate 20) to cover the plurality of pressure chambers 24, a piezoelectric layer 41 which is arranged on the upper surface of the vibration plate 40 to face the plurality of pressure chambers 24, and a plurality of individual electrodes 42 which are arranged on the upper surface of the piezoelectric layer 41.

The vibration plate 40 is, in a plane view, an approximately rectangular metallic plate which is, for example, formed of a ferrous alloy such as stainless steels and the like, a copper alloy, a nickel alloy, a titanium alloy, etc. This vibration plate 40 is joined to the upper surface of the cavity plate 20 so that the vibration plate 40 covers the plurality of pressure chambers 24. Further, the upper surface of the conductive vibration plate 40 acts as a common electrode for generating an electric field in the piezoelectric layer 41 in its thickness direction together with the plurality of individual electrodes 42 on the upper surface of the piezoelectric layer 41. The vibration plate 40, as the common electrode, is connected to a ground wire of a driver IC 47 which drives the actuator unit 7 to be always maintained at the ground potential.

The piezoelectric layer 41 is formed of a piezoelectric material composed mainly of lead zirconium titanate (PZT), which is a solid solution of lead titanate and lead zirconate, and which is a ferroelectric substance. As shown in FIG. 2, the piezoelectric layer 41 is formed continuously on the upper surface of the vibration plate 40 so as to cover the plurality of pressure chambers 24. Further, the piezoelectric layer 41 is polarized in the thickness direction at least in the areas which face the pressure chambers 24.

The plurality of individual electrodes 42 are arranged on the upper surface of the piezoelectric layer 41 in the areas facing the pressure chambers 24, respectively. Each of the individual electrodes 42 has a substantially elliptical shape which is one size smaller than that of the pressure chamber 24 as viewed in a plan view and faces the central portion of one of the pressure chamber 24. Further, from the end portions of the plurality of individual electrodes 42, a plurality of contact portions 45 extend in a longitudinal direction of the individual electrodes 42, respectively.

The plurality of contact portions 45 on the actuator unit 7 (the piezoelectric layer 41) are electrically connected to the driver IC 47 with a wiring member (not shown). Further, the driver IC 47 switches the potential of each of the individual electrodes 42 between a predetermined drive potential and the ground potential to jet an ink droplet from the nozzle 30 corresponding to the individual electrode 42.

Next, an explanation will be given with respect to the function of the actuator unit 7 at the time of jetting ink. When the driver IC 47 applies a predetermined drive potential to a certain individual electrode 42, a potential difference is produced between the individual electrode 42 to which the drive potential is applied and the vibration plate 40 which is maintained at the ground potential, thereby generating an electric field which acts in the thickness direction on the piezoelectric layer 41 sandwiched between the individual electrode 42 and the vibration plate 40. Since the direction of the electric field is parallel to the polarization direction of the piezoelectric layer 41, the piezoelectric layer 41 is contracted in the planar direction which is perpendicular to the thickness direction in the area facing the individual electrode 42 (active area). Here, since the vibration plate 40 under the piezoelectric layer 41 is fixed on the cavity plate 20, the vibration plate 40 deforms in the portion facing the pressure chamber 24 to form a projection toward the pressure chamber 24 (unimorph deformation), along with the contraction in the planar direction occurring in the piezoelectric layer 41 positioned on the upper surface of the vibration plate 40. At this time, because the volume of the pressure chamber 24 is decreased, ink pressure increases inside the pressure chamber 24, thereby jetting the ink from the nozzle 30 which communicates with the pressure chamber 24.

Further, a detailed explanation will be given with respect to driving the actuator unit 7 by the driver IC 47. When the ink-jet head 3 moves along with the carriage 2 in the scanning direction, the driver IC 47 supplies a drive signal having a predetermined drive waveform to each of the plurality of individual electrodes 42 of the actuator unit 7 in each of predetermined units of time (referred to as driving periods hereinafter) which are continuous in time, so as to switch the potential of each of the individual electrodes 42 as described hereinbefore.

The drive waveform of the drive signal is selected from four types of drive waveforms, the wavelength of which is equal to the driving period. FIGS. 5A to 5D show the four types of drive waveforms. Here in FIGS. 5A to 5D, the horizontal axis indicates time (t), while the vertical axis indicates drive voltage V (the potential difference between the drive potential applied to the individual electrode 42 and the ground potential). The four types of drive waveforms include a non-jet waveform which does not have a drive pulse P shown in FIG. 5A, and other three types of pulse waveforms which have at least one drive pulse P respectively shown in FIGS. 5B to 5D. During the driving period in which the signal with the non-jet waveform is applied to the individual electrode 42, no change occurs in the potential of the individual electrode 42, and thereby no liquid droplet is jetted from the nozzle 30.

Figure 5A:
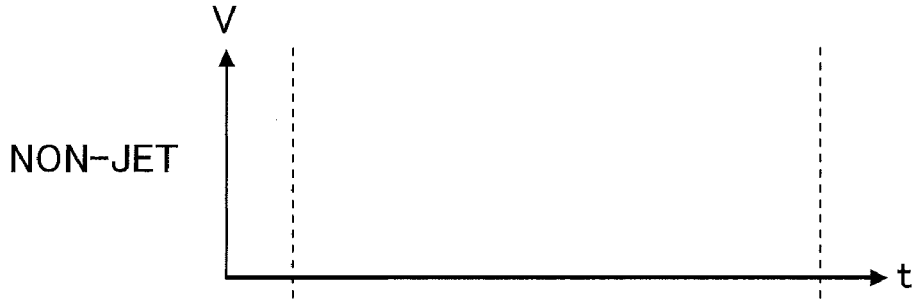
FIGS. 5A to 5D are diagrams showing four types of driving waveforms, respectively.
Figure 5B:
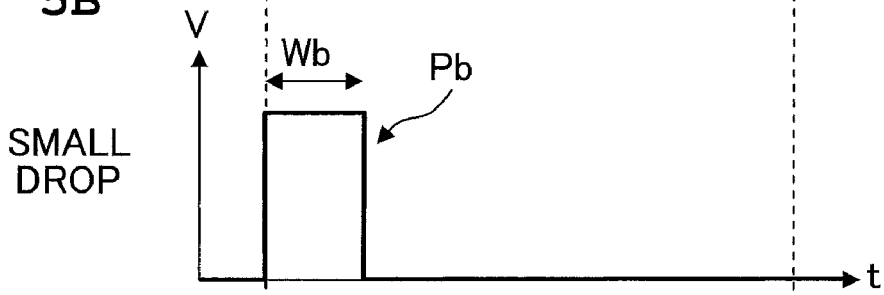
Figure 5C:
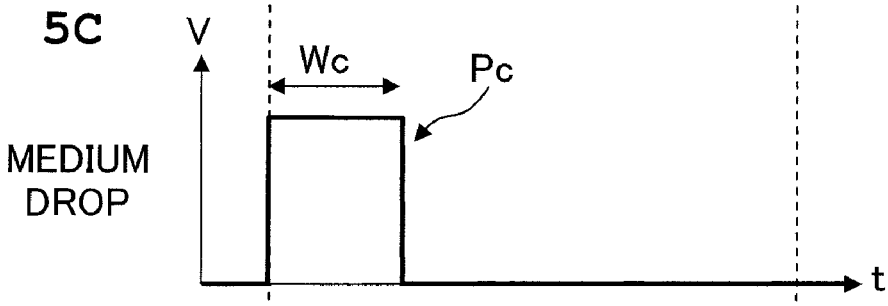
Figure 5D:
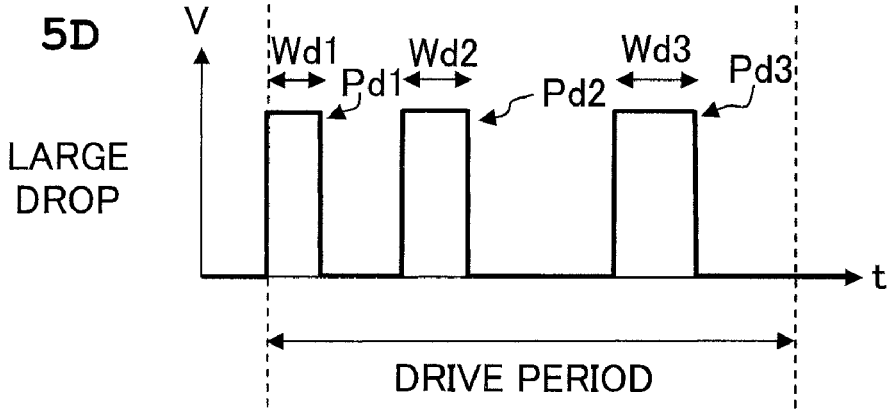

The three types of pulse waveforms shown in FIGS. 5B to 5D include a small drop waveform which has one drive pulse Pb; a medium drop waveform which has, likewise, one drive pulse Pc; and a large waveform which has three drive pulses Pd. The small drop waveform and the medium drop waveform are the same in the number of the drive pulse P, which is one, but different in pulse width W. If this pulse width W is too narrow, it may not be possible to apply a sufficient pressure to the ink inside a pressure chamber 24 for jetting a liquid droplet from the nozzle 30. That is, the energy applied to the liquid droplet is changed depending on the pulse width W.

In the embodiment, the pulse width Wc of the drive pulse Pc of the medium drop waveform is nearly an ideal pulse width which is capable of most efficiently applying a pressure (energy) to the ink inside a pressure chamber 24. On the other hand, the pulse width Wb of the drive pulse Pb of the small drop waveform is a little narrower than the pulse width Wc of the medium drop waveform. Hence, during the driving period for which the small drop waveform is selected, compared with the medium drop waveform, the pressure applied to the ink is smaller. Accordingly, the jetting amount of the ink is less than that of the driving period with respect to which medium drop waveform is selected.

On the other hand, since the large drop waveform has three drive pulses Pd, the pressure is applied to the ink inside a pressure chamber 24 on the timing of applying these three drive pulses Pd to jet three liquid droplets consecutively from the nozzle 30 within one driving period. In this manner, during the driving period with respect to which the large drop waveform is selected, three liquid droplets are jetted. Accordingly, the jetting amount of the ink jetted from the nozzle 30 is more than that of the driving period with respect to which the small drop waveform or the medium drop waveform is selected. As described above, the jetting amount of the ink within one driving period, that is, the size of a dot formed on the recording paper 100, is in the order of: the small drop waveform<the medium drop waveform<the large drop waveform. Here, the small drop waveform and medium drop waveform correspond to the first driving waveform of the present teaching, and the large drop waveform which has more drive pulses than these small drop waveform and medium drop waveform corresponds to the second driving waveform of the present teaching.

Further, the three drive pulses Pd1 to Pd3 of the large drop waveform are different in pulse width W from each other. More specifically, the drive pulse Pd which is applied later in time is broader in pulse width Wd to be nearly the ideal pulse width (the pulse width We of the medium drop). Therefore, the first liquid droplet, which is jetted by the first drive pulse Pd1 with a pulse width farthest from the ideal pulse width, is the lowest in jetting velocity. On the other hand, the last liquid droplet, which is jetted by the last drive pulse Pd3 with a pulse width closest to the ideal pulse width, is the highest in jetting velocity. Accordingly, it is possible to locate the landing positions of the first and last liquid droplets on the recording paper 100 as close as possible to the central position (the landing position of a middle liquid droplet between the first and last liquid droplets).

However, since the large drop waveform has more drive pulses P than either the small drop waveform or the medium drop waveform, there is a restriction to the large drop waveform with respect to degree of freedom in determining the pulse width. In particular, in order to efficiently apply a high pressure to the ink, it is preferable to be the pulse width Wd of the drive pulse Pd near to the ideal pulse width. Yet, because of the time restriction that three drive pulses Pd have to be put within one driving period, the pulse width Wd of each drive pulse Pd has to be narrowed.

Further, if the pulse widths Wd of the three drive pulses Pd are widened and a high pressure is applied to the ink by each of the drive pulses Pd, pressure waves may be overlapped inside the ink flow passage, thereby causing the pressure inside the pressure chamber 24 to undergo a great change as the last drive pulse Pd3 is being applied. As a result, the liquid droplets may be jetted unstably from the nozzle 30. In order to prevent the liquid droplets from being jetted unstably, such a measure is often taken as to put a sufficient interval between the drive pulses P, or to apply a small pulse (stabilization pulse) for restraining the residual pressure wave after the drive pulse P is applied. However, because of the aforementioned restriction in time to the large drop waveform, it is difficult to broaden the pulse interval or to apply the stabilization pulse.

Therefore, as shown in FIGS. 5B to 5D, the pulse widths Wd of the three drive pulses Pd of the large drop waveform are narrower than those of the drive pulse Pb of the small drop waveform and the drive pulse Pc of the medium drop waveform. Thus, the three liquid droplets, which are jetted as the large drop waveform is selected, become lower in jetting velocity than the liquid droplet which is jetted when the small drop waveform or medium drop waveform is selected, thereby causing a problem that the landing positions of the large droplets on the recording paper 100 are deviated. Descriptions will be made later with respect to the details on the landing position deviation, and to the measures thereagainst.

Figure 6:
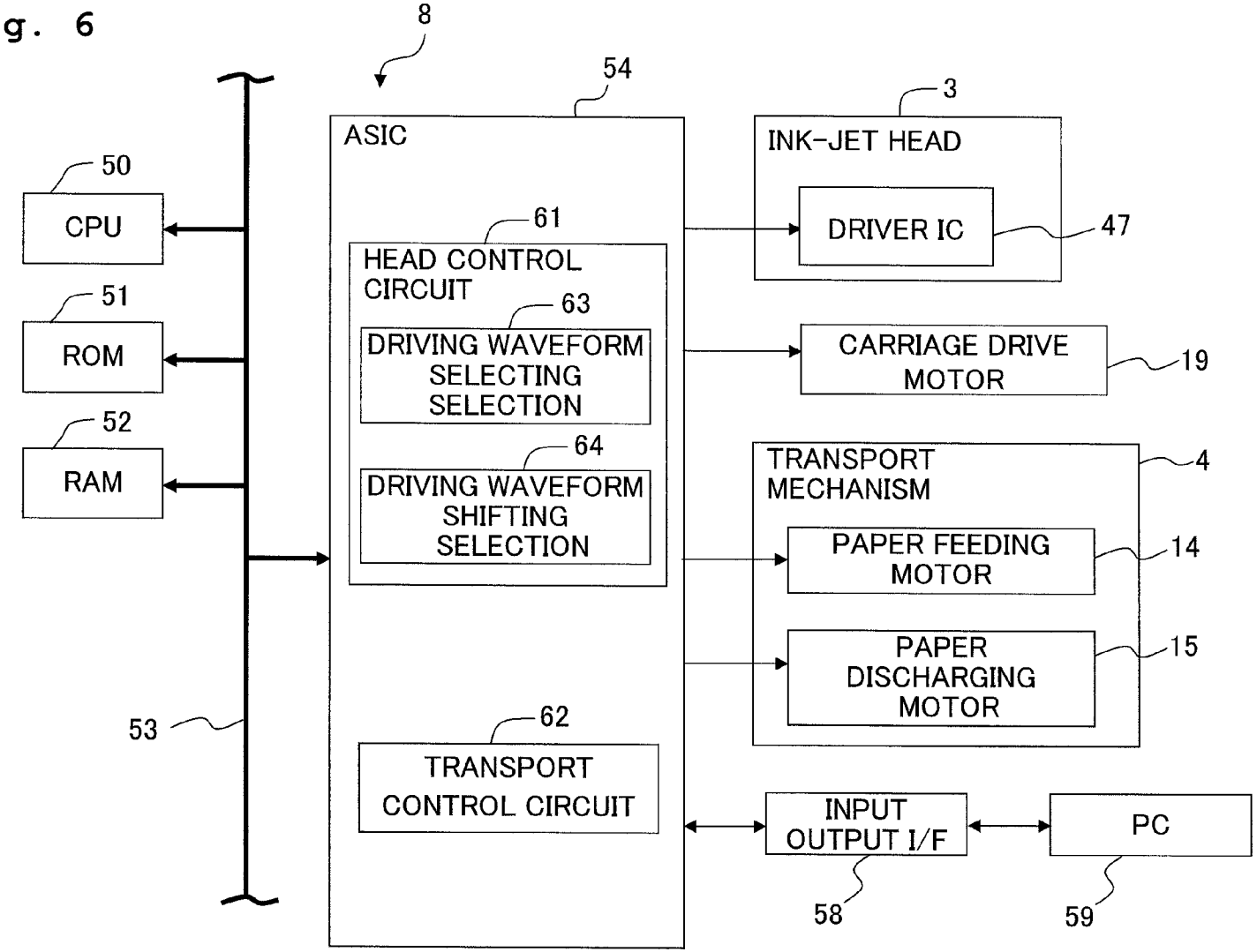
FIG. 6 is a block diagram showing an electrical construction of the printer.

Next, an explanation will be given in reference to the block diagram of FIG. 6 with respect to an electrical construction of the printer 1. As show in FIG. 6, a control unit 8 has a microcomputer composed of a CPU (Central Processing Unit) 50, a ROM (Read Only Memory) 51, a RAM (Random Access Memory) 52, and a bus 53 for connecting these components. Further, the bus 53 is in connection with an ASIC (Application Specific Integrated Circuit) 54 which controls the driver IC 47 of the ink-jet head 3, the carriage drive motor 19 for driving the carriage 2, the paper feeding motor 14 and the paper discharging motor 15 of the transport mechanism 4, etc. Further, the ASIC 54 is connected to an external PC (Personal Computer) 59 via an input and output interface (I/F) 58 for data communications.

Further, the ASIC 54 includes a head control circuit 61 for controlling the driver IC 47 of the ink-jet head 3 and the carriage drive motor 19 respectively, based on print data inputted from the PC 59; and a transport control circuit 62 for controlling the paper feeding motor 14 and the paper discharging motor 15 of the transport mechanism 4 respectively, based on the print data.

Next, an explanation will be given in detail with respect to the head control circuit 61 as a jetting controller. The head control circuit 61 is provided with a driving waveform selecting section 63. Based on the print data inputted from the PC 59, the driving waveform selecting section 63 selects or determines one waveform from the aforementioned four types of waveforms (see FIGS. 5A to 5D) for each of the driving periods which are continuous in time. Further, the head control circuit 61 sends the drive waveform selected for each of the driving periods to the driver IC 47 and the driver IC 47 amplifies the drive waveform to generate a drive signal of a predetermined voltage. This drive signal is supplied to each of the plurality of individual electrodes 42 of the actuator unit 7 and the ink is jetted selectively from one of the plurality of nozzles 30 which respectively correspond to the individual electrodes 42 during each of the driving periods of the ink-jet head 3.

Figure 7:
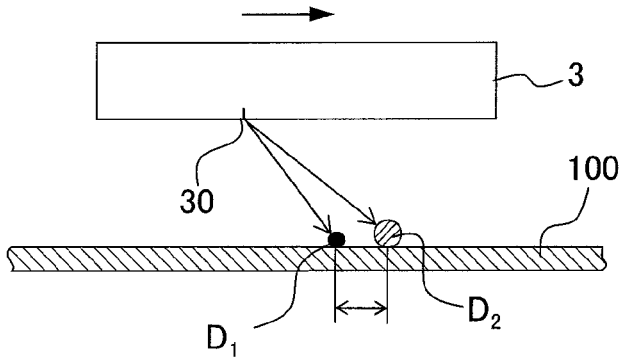
FIG. 7 is a view showing respective trajectories of a large droplet and a medium droplet when jetted from a nozzle.

However, as described hereinbefore in the explanation with respect to the drive waveforms, each of the pulse widths Wd of the three drive pulses Pd of the large drop waveform is narrower than those of the drive pulse Pb of the small drop waveform and drive pulse Pc of the medium drop waveform. Therefore, the jetting velocities of the three liquid droplets (simply' referred to as a large drop as well, hereinbelow), which are jetted when the large drop waveform is selected, become lower than that of the liquid droplet (small drop) when the small drop waveform is selected, and that of the liquid droplet (medium drop) when the medium drop waveform is selected. Such differences in jetting velocities of the liquid droplets show up on the recording paper 100 as the deviations or differences of the landing positions. FIG. 7 shows respective trajectories of the large drop and the medium drop jetted from a nozzle 30. The large drop is actually composed of three liquid droplets which are jetted from the nozzle 30 at different timings; however, for the simplicity of the drawing, the large drop is shown as one large liquid droplet D2 in FIG. 7. As shown in FIG. 7, when an ink droplet is jetted from the nozzle 30 while the ink-jet head 3 is moving in the direction of arrow, it takes a longer time for the large drop D2 which is low in jetting velocity to land on the recording paper 100 in comparison with the medium drop D1. As a result, the landing position of the large drop D2 deviates from that of the medium drop D1 in the moving direction of the ink-jet head 3 (the direction of arrow).

Figure 8:
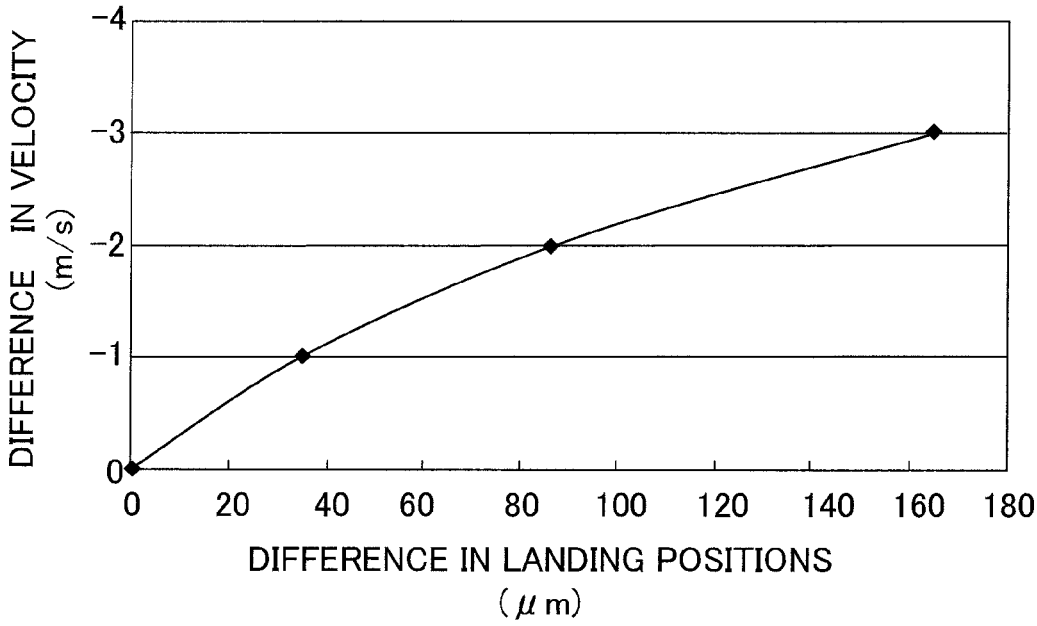
FIG. 8 is a graph showing a relationship between the difference in jetting velocities of liquid droplets and the difference in landing positions.

Such differences in jetting velocities between the liquid droplets may cause a great deviation of landing position deviation of the large drop. The landing position of the large drop may be deviated from desired position by one dot or more. FIG. 8 is a graph showing a relationship between difference in the jetting velocities of liquid droplets and the difference or deviation in the landing positions. FIG. 8 illustrates how much landing position of a liquid droplet with a lower jetting velocity may deviate from landing position of another liquid droplet with a jetting velocity of 7 m/s. Here, in the experiment of FIG. 8, a 1.8 mm gap is taken between the nozzle 30 of the ink-jet head 3 and the recording paper 100.

As known from FIG. 8, when the difference in jetting velocities is 1 m/s (the velocities of the two types of liquid droplets are 7 m/s and 6 m/s), the difference of the landing positions is about 40 μm. This is almost equivalent to one dot at the resolution of 600 dpi (42.3 μm). That is, if the difference in jetting velocities between the medium drop and the large drop is 1 m/s or more, the landing positions of the medium drop and large drop are different from each other by one dot or more. If the landing position of the large drop deviates by one dot or more, the deviation becomes conspicuous, thereby greatly degrading the print quality. Therefore, it is necessary to restrain the large drop from deviation of landing position as much as possible.

As described above, the difference in jetting velocities between the liquid droplets causes the landing position of the large drop to deviate from the landing position of the medium drop or the small drop. Here, in order to restrain the large drop from deviation of landing position, it is conceivable to lower the jetting velocities of the medium drop and small drop so as to make them come close to that of the large drop by narrowing the pulse widths of the drive pulses P of the medium drop and small drop. However, lowering the jetting velocity of the liquid droplet may cause unstable flights of the liquid droplets, and the unstable flights cause deviation of the landing positions. This is, especially, conspicuous in the small drop which is the smallest in liquid droplet. In this manner, it is not preferable to lower the jetting velocities of the medium drop and small drop to be close to the jetting velocity of the large drop, because this may cause an overall instability of the liquid droplet movements, thereby greatly lowering the print quality.

Further, in the embodiment, the large drop is actually composed of three liquid droplets which are jetted at different timings. Therefore, if each of the liquid droplets composing the large drop is lower in velocity than the medium drop or small drop, it is conceivable that the three liquid droplets may become unstable in flight as described above. However, since the medium drop and small drop are small in number of liquid droplet (only one for each in the embodiment), a great influence may be brought on the print quality when the liquid droplet becomes unstable in flight and the landing position deviates from the desired landing position. On the contrary, since the large drop is composed of three liquid droplets, the influence from each of the liquid droplets being unstable in flight may not so great as was brought by the medium drop and small drop. For example, if one liquid droplet is unstable in flight while the other two liquid droplets are normal in flight, the landing position of the large drop, as a whole, deviates little from the desired landing position (the center of the landing positions of the three liquid droplets). Further, even if the three liquid droplets are all unstable in flight, the deviations of the landing positions are balanced out to a certain extent among the three liquid droplets. Thus, the position of the large drop, as a whole, does not deviate greatly from its position which is the center of the landing positions of the three liquid droplets.

Here in the embodiment, application of the large drop waveform is advanced to restrain the large drop from deviation of landing position of the large drop. As shown in FIG. 6, the head control circuit 61 is provided with a driving waveform shifting section 64. When the driving waveform selecting section 63 has selected the large drop waveform with respect to a certain driving period, the driving waveform shifting section 64 shifts the large drop waveform from the certain driving period with respect to which the large drop waveform is selected to a driving period which is one period ahead of the certain driving period. Namely, jetting timing of the large drop is moved forward by one driving period.

FIG. 9 shows examples in which the large drop waveforms are shifted as described above. FIG. 9 gives six examples of No. 1 to No. 6, each of which shows how the waveforms, which are selected with respect to seven continuing driving periods A to G, are shifted before and after the shifting. Here in FIG. 9, "L", "M", "S", and "—" indicate that a large drop waveform, a medium drop waveform, a small drop waveform, and a non-jet waveform are selected, respectively.

No. 1 is an example of utilizing the large drop only. The large drop waveforms are shifted one period ahead respectively (C→+B; E→D). Further, to the driving periods (C and E) with respect to which the large drop waveforms were selected before the shifting, the non-jet waveforms are assigned.

Further, No. 2 is an example of jetting a medium drop immediately after jetting a large drop two times. Only the large drop waveforms are shifted one period ahead respectively (C→B; D→C). The medium drop waveform is not shifted. As a result, there is a driving period D during which the ink is not jetted between the driving period C to which the large drop waveform is shifted and the driving period E with respect to which the medium drop waveform has been originally selected. Nevertheless, since a delay of landing occurs in the large drop jetted during the driving period C after the shifting, the large drop almost adjoins the medium drop jetted during the driving period E on the recording paper 100.

No. 3 is an example of utilizing a medium drop between large drops. Also in this case, only the large drop waveforms are shifted one period ahead respectively (C→B; E→D; F→E). However, if the large drop waveform which is selected with respect to the driving period E is shifted to the driving period D which is one period ahead and with respect to which the medium drop waveform has been selected before the shifting, large drop waveform will overlap with the medium drop waveform. Here, the driving waveform selecting section 63 cancels the selection of the medium drop waveform with respect to the driving period D, and then the driving periods shifting section 64 shifts the large drop waveform, which was selected with respect to the following driving period E before the shifting, to the driving period D.

Further, when the medium drop (or small drop) waveform is selected with respect to a driving period just before a driving period with respect to which a large drop waveform is selected, canceling the medium drop (or small drop) waveform means not jetting the medium drop (or small drop) which should be jetted by the medium drop (or small drop) waveform. However, this does not bring about so much influence on printing. Usually, when print density or darkness is allowed to be low, the medium drop or small drop, which is small in liquid droplet jetting amount within one driving period, is mainly utilized; and when it is necessary to increase the density or darkness, the large drop is utilized which is large in liquid droplet jetting amount within one driving period. In this manner, because there is difference in usage between the medium drop or small drop and the large drop, it is not likely to utilize the medium drop or small drop with the large drop at a comparable rate with each other, for example, to print in such a manner as the large drop and the medium drop are aligned alternately. That is, when the large drop waveform is shifted ahead by one period, it is low in probability to overlap with the medium drop waveform selected before the shifting such as the case in No. 3.

Further, the aforementioned Japanese Patent Application Laid-Open No. 2002-86766 describes that the timing is advanced for jetting the small drop because the jetting velocity of the small drop is low. In this case, when a large drop waveform is selected with respect to a driving period which is just before a driving period with respect to which a small drop waveform is selected, if the large drop waveform is canceled by shifting the small drop waveform one period ahead so as to advance the small drop jet timing, the large dot will not be formed on the recording paper. This may greatly affect the print quality. On the other hand, as in the embodiment, if the driving period of a large drop is advanced, while canceling the selection of the preceding waveform of a medium drop or small drop, the print quality is little affected. Further, when the large drop waveform is shifted ahead, there is extremely little negative influence on the print quality brought by the fact that the medium drop or small drop will not be formed on the recording paper, compared with the improvement in print quality by reducing the deviation of landing position of the large drop.

Further, No. 4 in FIG. 9 is an example of jetting a medium drop just before a large drop. In this case, only the large drop waveform is shifted one period ahead (F→E), and the selection of the medium drop waveform, which was selected with respect to the driving period E before the shifting, is canceled. No. 5 is an example of utilizing a small drop just after a large drop. Only the large drop waveforms are shifted one period ahead respectively (D→C; C→B), and the small drop waveform is not shifted. No. 6 is an example of only utilizing medium drops and a small drop. Since no large drops are utilized, the medium drop waveforms and the small drop waveform are not shifted at all.

As described above, when a large drop waveform is selected with respect to a driving period, the large drop waveform is shifted one period ahead to reduce the deviation of landing position of the large drop, thereby making it possible to restrain the print quality from decreasing.

Figure 10A:
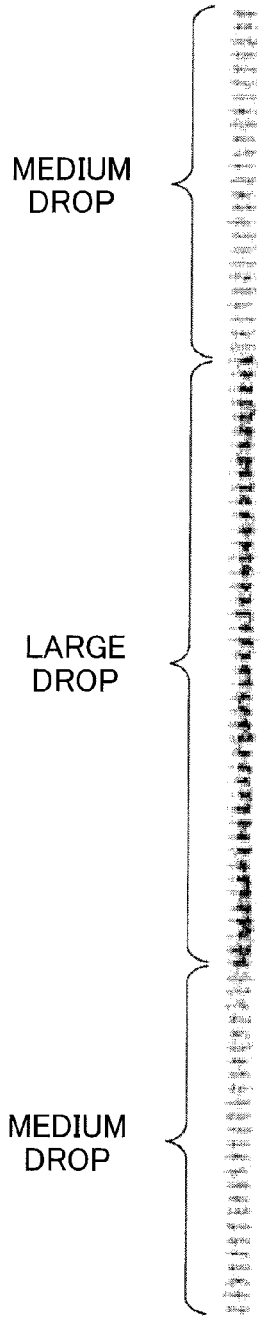
FIGS. 10A to 10C are views showing printing results in which the large drop waveforms are shifted and are not shifted (one-way printing)
Figure 10B:
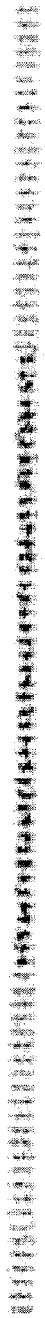
Figure 10C:
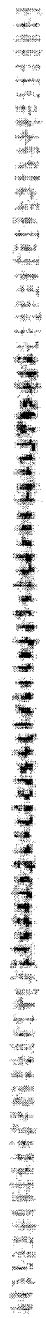
Figure 11A:
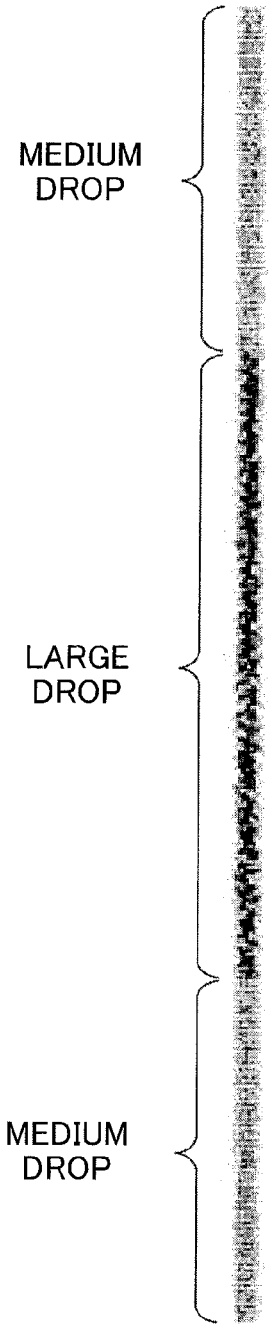
FIGS. 11A to 11C are views showing printing results in which the large drop waveforms are shifted and are not shifted (two-way printing)
Figure 11B:
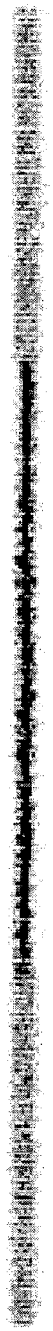
Figure 11C:
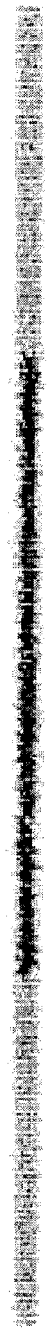

FIGS. 10A to 10C and FIGS. 11A to 11C show the results of actually carrying out printing with and without shifting the large drop waveform. FIGS. 10A to 10C are results of printing a line extending in the transport direction by jetting ink droplets while moving the ink jet head 3 rightward (one-way) in the view respectively. FIGS. 11A to 11C are results of printing a line extending in the transport direction by jetting ink droplets while moving the ink-jet head 3 leftward and rightward (two-way) in the view respectively. Further, FIGS. 10A and 11A are the printing results of not shifting the large drop waveform in the state that there is a difference in jetting velocities between the large drop and the medium drop. FIGS. 10B and 11B are the printing results of shifting the large drop waveform in the state that there is a difference in velocities between the large drop and the medium drop (an example of applying the present invention). FIGS. 10C and 11C are the printing results in a state that there is no difference in jetting velocities between the large drop and the medium drop.

In FIG. 10A in which the large drop waveform is not shifted, due to the difference in jetting velocities between the large drop and medium drop, the landing positions of the large drops (the dark portion) deviate in the head moving direction (to the right side of the view) in comparison with those of the medium drops. Further, it is known from FIG. 11A that, due to the difference in jetting velocities between the large drop and medium drop, the landing positions of the large drops deviate in the head moving direction (the left and right directions of the view) and thereby being dispersed in the head moving direction in comparison with those of the medium drops. On the other hand, from FIGS. 10B and 11B in which the large drop waveforms are shifted ahead respectively, it is known that no deviations in landing position can be found between the large drops and the medium drops, and these results are comparable respectively with those of FIGS. 10C and 11C which show ideal states that there is no difference in jetting velocities between the large drop and the medium drop and that the landing positions do not deviate.

Next, explanations will be given with respect to modifications in which the embodiment is modified in various manners. It should be appreciated that, however, the constitutive parts or components, which are the same as or equivalent to those of the embodiment described above, are designated by the same reference numerals, any explanation of which will be omitted as appropriate.

In the embodiment, it is necessary for the large drop waveform to include more drive pulses P within a driving period which is the same as that for the medium drop waveform or small drop waveform. Therefore, the width of the drive pulse P of the large drop waveform was narrowed in comparison with the medium drop waveform and the small drop waveform. However, only in the case that no liquid droplet is jetted during the period just after a large drop is jetted, it is possible to make the large drop waveform longer than one driving period so as to ease the restriction in time on the pulse width of the drive pulse.

Figure 12A:
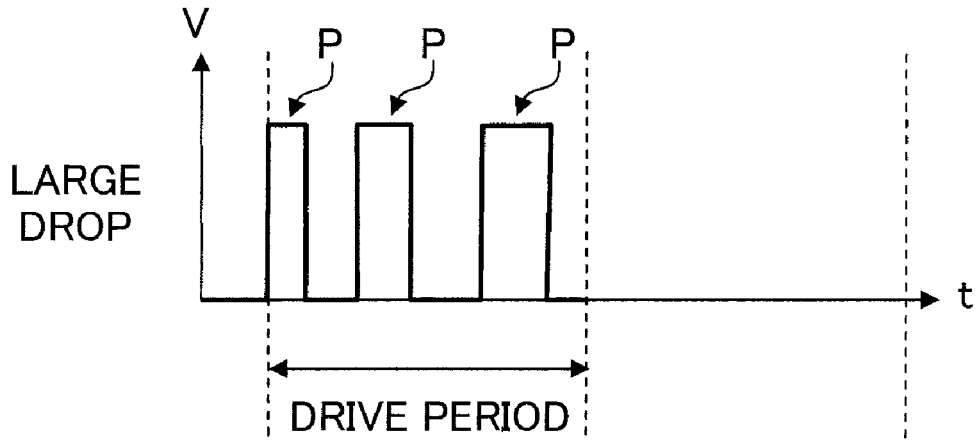
FIGS. 12A and 12B are diagrams showing a large drop waveform and a large drop long waveform, respectively, according to a modification.
Figure 12B:
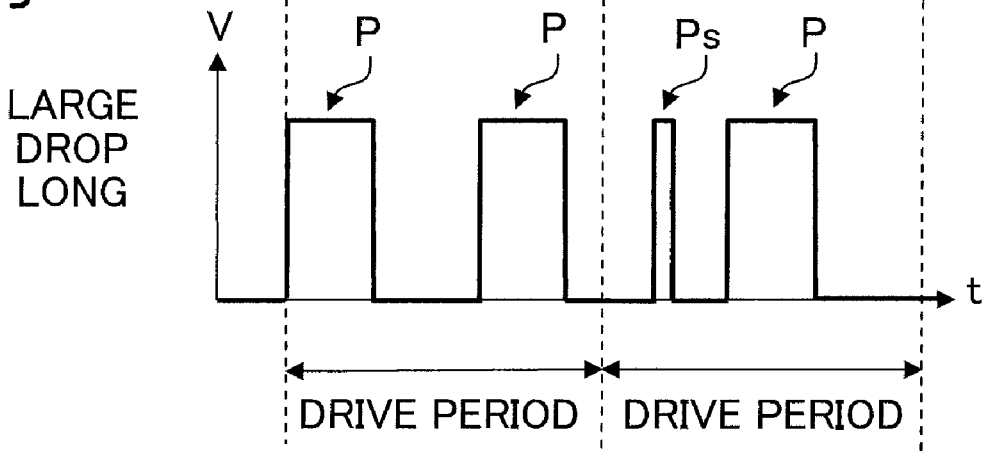

In particular, the driving waveform selecting section 63 is capable of selecting a large drop long waveform (FIG. 12B: a third driving waveform) in addition to the large drop waveform (FIG. 12A). The large drop long waveform has the same number of the drive pulses P as the large drop waveform but extends over two driving periods which are longer than that of the large drop waveform. Since the large drop long waveform and large drop waveform have the same number of the drive pulses P, the same number and almost the same amount of the liquid droplets are jetted with each other. Further, the pulse Ps in FIG. 12B is not a pulse for jetting the liquid droplet (drive pulse P) but a stabilization pulse which is considerably narrow in width in comparison with the drive pulse P, and utilized for reducing the residual pressure waves inside the ink flow passage.

In the large drop long waveform which is longer than one driving period, there is little restriction in time in comparison with the large drop waveform. Hence, the pulse width of the drive pulse P may be determined more freely to be close to that of the medium drop waveform or small drop waveform. Further, as shown in FIG. 12B, since it is possible to apply a stabilization pulse Ps in between the drive pulses P, or to provide a sufficiently long interval between the drive pulses P in comparison with the large drop waveform, even if a high pressure is applied to the ink with each of the drive pulses P, the pressure inside the ink flow passage can be restrained from changing greatly and thereby the jetting stability can be secured. Therefore, it is possible to raise the liquid droplet jetting velocity to a higher rate than that of the large drop waveform when the large drop long waveform is selected so as to reduce the deviation of landing position to a lower level in comparison with the large drop waveform.

Here, when the large drop waveform is selected with respect to a driving period, the driving waveform shifting section 64 shifts the large drop waveform to the preceding driving period. However, when a large drop long waveform is selected, it may also be configured not to shift the large drop long waveform. Further, the large drop long waveform described in FIG. 12B extends over two driving periods in wavelength, and the first drive pulse P is on the anterior end of the first driving period. However, the first drive pulse P may not be limited to this but be positioned apart from or later than the anterior end of the driving period. With this, it is possible to freely set the landing position of the large drop jetted with the large drop long waveform.

As it is known from FIG. 8 in accordance with the aforementioned embodiment, depending on jetting velocities of the liquid droplets of the medium drop and large drop, the landing position of the large drop may deviate from the desired position by two dots (approximately 80 μm deviation in landing position at 600 dpi) or more. Here, when the large drop waveform is selected with respect to a driving period, the driving waveform shifting section 64 may also shift the large drop waveform to a driving period which is two periods ahead or more.

Further, according to various conditions such as the types of drive waveforms, print modes, and the like, it is also possible to change the shifting amount of the driving period. For example, when the aforementioned large drop long waveform (FIG. 12B) is utilized together with the large drop waveform, the large drop waveform may also be shifted two periods ahead, and the large drop long waveform may be shifted one period ahead.

Further, according to the types of inks to be jetted, the degree of shifting the driving waveform may also be changed. For a color ink-jet printer, it is common to set the black ink dot larger than the color ink dot. If this is realized by varying the number of drive pulses within one driving period (the number of liquid droplets jetted within one driving period), it is necessary to set the number of drive pulses of the large drop waveform for the black ink to be greater than that for the color ink. In this case, for the reason described hereinbefore, a greater deviation of landing position occurs in the large drop waveform for the black ink including more drive pulses in comparison with the large drop waveform for the color inks. Here, when the large drop waveform is selected for the black ink, the large drop waveform for the black ink may also be shifted two periods ahead; and when the large drop waveform is selected for the color ink, the large drop waveform for the color ink may be shifted one period ahead.

Further, according to the print modes, the degree of shifting the driving waveform may also be changed. For example, when it is possible to select two different print modes: a usual print mode for printing an image with a standard image quality, and a high quality print mode for printing an image which is higher in image quality than that with the usual print mode, it is common to diminish the dot in size for the high quality print mode in comparison with the usual print mode, to achieve a high-definition image printing. Here, the number of the drive pulses included in the large drop waveform for the usual print mode is set to be more than that for the high quality print mode. Accordingly, when the large drop waveforms are selected in the usual print mode and the high quality print mode, the dots may be changed in size according to the different print modes. In such case, when the large drop waveform is selected in the usual print mode including more drive pulses, the large drop waveform may be shifted two periods ahead; and when the large drop waveform is selected in the high quality print mode, the large drop waveform may be shifted one period ahead.

In the embodiment, the three drive pulses of the large drop waveform are different in pulse width from each other (FIG. 5D). However, it is possible to land at least two liquid droplets of the large drop at positions adjacent to each other only by letting at least two drive pulses be different in pulse width to differentiate jetting velocities of the at least two liquid droplets. Further, when it is unnecessary to land the liquid droplets of the large drop at positions adjacent to each other, all the drive pulses may also be formed with a same pulse width.

In the embodiment, all the large drop waveforms are shifted to the preceding periods. However, the large drop waveforms may also be shifted to the preceding periods only in part. The inventors have perceived that when the large drops are consecutively jetted, the first large drop differs in jetting velocity from the succeeding large drop(s), namely, the first large drop is lower in jetting velocity. The reason why the first large drop is lower in jetting velocity is conceivable as follows. When succeeding large drops are jetted after the first large drop, the meniscus position of the ink is changed due to the jetting of the preceding large drops. Accordingly, it is possible to raise the jetting velocities of the succeeding large drops by using the change of the meniscus position of the ink On the other hand, when the first large drop is jetted, it is impossible to use the change of the meniscus position of the ink. Therefore, for stabilizing the jetting velocities of the succeeding large drop(s), the first large drop is generally lower in jetting velocity than the succeeding large drop(s). Here, when the large drops are successively jetted, the first large drop waveform is may also be shifted two periods ahead while the succeeding large drop waveforms are shifted one period ahead respectively. It may be possible that the first large drop waveform is shifted two periods ahead and the large drop waveform is also changed to a large drop long waveform. Further, the first drive pulse of the large drop long waveform may be placed at a position apart from or later than the anterior end of driving period which is two periods ahead of the period so as to adjust the landing position of the large drop jetted by the large drop long waveform. In this case, the succeeding large drop waveforms may not be shifted. Further, when the large drops are successively jetted, it may be possible that only the first large drop waveform is shifted one period ahead of the period and the succeeding large drop waveforms are not shifted.

In the embodiment, as the method for driving the actuator unit 7 of the ink-jet head 3, a so-called push type method is explained as an example. That is a method in which the piezoelectric layer 41 does not deform in the standby state, and when the drive pulse is applied, a pressure is applied to the ink inside the pressure chamber 24 by a deformation which occurs in the piezoelectric layer 41 due to the electric field acting on the piezoelectric layer 41. However, as a method for driving the actuator unit 7, other than the push type method, there is also known, as will be described below, a pull type method.

Figure 13A:
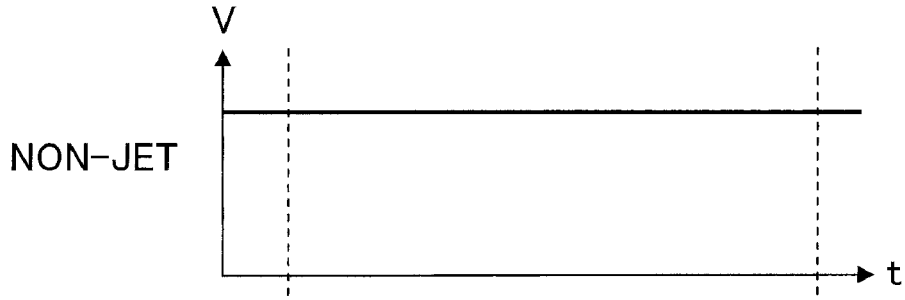
FIGS. 13A to 13D are diagrams showing four types of driving waveforms, respectively, according to another modification.
Figure 13B:
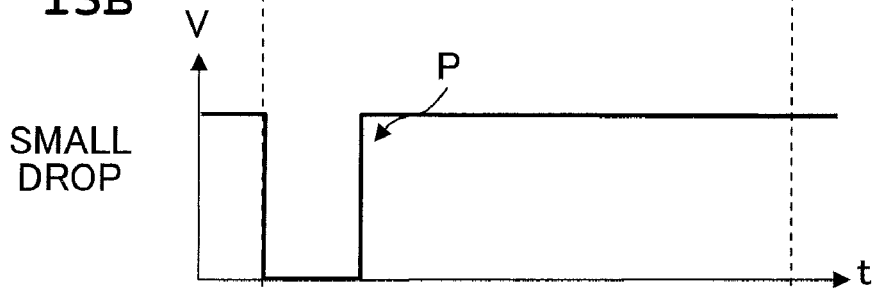
Figure 13C:
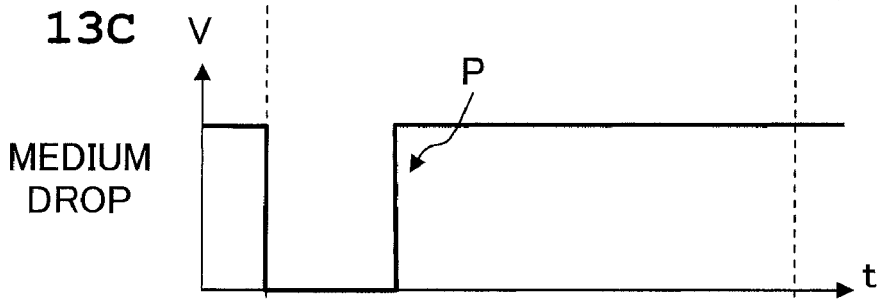
Figure 13D:
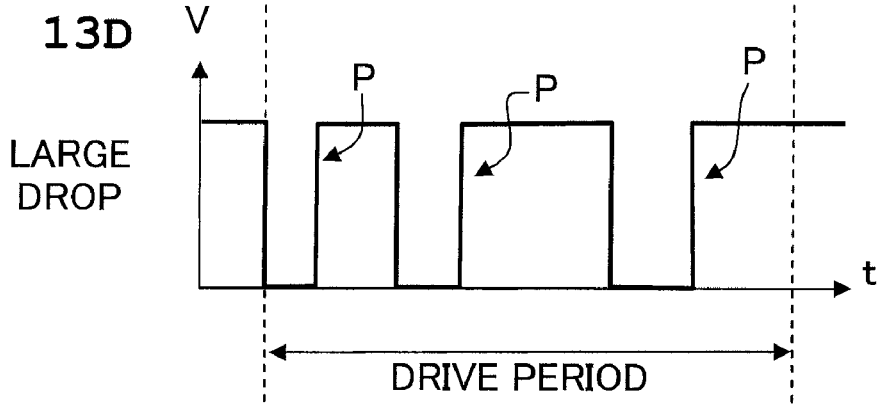

FIGS. 13A to 13D show the drive waveforms when the pull type method is adopted. As shown in FIG. 13A, in the pull type method, the individual electrodes 42 shown in FIG. 4 are maintained at a predetermined potential in the standby state that the drive pulse P is not applied. That is, in the standby state, an electric field of the thickness direction acts on the active areas of the piezoelectric layer 41. Hence, the piezoelectric layer 41 deforms convexly toward the side of pressure chambers 24, and the volumes of the pressure chambers 24 are in a state of being reduced.

As the drive pulse P is applied in this state, the individual electrode 42 is once switched to the ground potential. Hence, the piezoelectric layer 41 is released from deformation so that the pressure chamber 24 rapidly increases in volume. Accordingly, a pressure wave occurs inside the pressure chamber 24. Then, after a certain period of time (corresponding to the pulse width of the drive pulse P), the individual electrode 42 is switched again to the drive potential so that the piezoelectric layer 41 convexly deforms toward the side of the pressure chamber 24 again. Accordingly, the pressure wave occurs again inside the pressure chamber 24.

Here, the pressure wave which occurred earlier inside the pressure chamber 24 propagates to the manifold 27 side, turns around at the connection portion with the manifold 27, and comes back to the pressure chamber 24 again. Therefore, if the pulse width is set such as to generate a second pressure wave inside the pressure chamber 24 at the time at which the turned-around pressure wave has just come back to the pressure chamber 24, it is possible to overlap these two pressure waves inside the pressure chamber 24, thereby allowing a great pressure to be efficiently applied to the ink inside the pressure chamber 24. Contrarily, the more an actual pulse width deviates from the ideal pulse width which can overlap the two pressure waves, the more the energy applied to the ink decreases, and thereby the lower the liquid droplet becomes in jet velocity.

In this manner, the pulse width affects the jetting velocity of the liquid droplet more in the pull type method than in the push type method, and when an actual pulse width deviates from the ideal pulse width, the large drop tends to deviate greatly in landing position. Hence, the present invention may be applied not only to the push type method but also to the pull type method if adopted.

The embodiment and modifications explained above are merely examples of applying the present invention to an ink jet printer which forms images and the like by jetting ink droplets on the recording paper 100. However, the objects of applying the present invention are not limited to such an ink-jet printer but may be liquid droplet jetting apparatuses utilized in various technical fields.

What is claimed is:

1. A liquid droplet jetting apparatus which jets liquid droplets, the apparatus comprising:

a liquid droplet jetting head which has a nozzle for jetting the liquid droplets; and a jetting controller which controls the liquid droplet jetting head to jet the liquid droplets from the nozzle by supplying the liquid droplet jetting head with a driving signal having a predetermined drive waveform in each of continuing driving periods, and which includes: a driving waveform selecting section which selects, with respect to each of the continuing driving periods, one driving waveform from a plurality of driving waveforms each having a wavelength which is same as a length of one driving period; and a driving waveform shifting section which shifts the driving waveform, selected by the driving waveform selecting section with respect to one driving period among the continuing driving periods, to another driving period which is before the one driving period based on a type of the driving waveform, wherein the driving waveforms have at least three types of driving waveforms which include a first driving waveform having at least one driving pulse for jetting the liquid droplets, a second driving waveform having driving pulses more than the first driving waveform for jetting the liquid droplets more than the first driving waveform, and a non-jetting waveform having no drive pulse, and when the driving waveform selecting section selects the second driving waveform with respect to the one driving period, the driving waveform shifting section shifts the second driving waveform from the one driving period to the another driving period which is before the one driving period.

2. The liquid droplet jetting apparatus according to claim 1, wherein when the driving waveform shifting section shifts the second driving waveform to the another driving period with respect to which the driving waveform selecting section has selected the first driving waveform, the driving waveform selecting section cancels the first driving waveform which has been selected with respect to the another driving period.

3. The liquid droplet jetting apparatus according to claim 1, wherein at least two driving pulses of the driving pulses included in the second driving waveform are different in width from each other.

4. The liquid droplet jetting apparatus according to claim 1, wherein the driving waveforms further include a third driving waveform having same number of driving pulses as the second driving waveform and having a wavelength longer than the length of one driving period; and when the driving waveform selecting section selects the third driving waveform with respect to the one driving period among the continuing driving periods, the driving waveform shifting section does not shift the third driving waveform.

5. The liquid droplet jetting apparatus according to claim 1, further comprising a moving mechanism which moves the liquid droplet jetting head, wherein the nozzle is formed as a plurality of nozzles which form a plurality of nozzle rows each extending in a row direction, and the liquid droplet jetting head jets the liquid droplets while being moved by the moving mechanism in a direction perpendicular to the row direction.

6. The liquid droplet jetting apparatus according to claim 1, wherein when the second driving waveforms are selected by the driving waveform selecting section with respect to continuing driving periods, the driving waveform shifting section shifts only the second driving waveform which is selected with respect to the first driving period among the continuing driving periods to another driving period which is before the first driving period.

7. The liquid droplet jetting apparatus according to claim 1, wherein when the second driving waveforms are selected by the driving waveform selecting section with respect to continuing driving periods, the driving waveform shifting section shifts the second driving waveform which is selected with respect to the first driving period among the continuing driving periods to a driving period which is two periods ahead of the first driving period, and shifts the second driving waveforms which are selected with respect to the driving periods following the first driving period to driving periods which are one period ahead of the driving periods respectively.

8. The liquid droplet jetting apparatus according to claim 1, wherein the jetting controller drives the liquid droplet jetting head with a first print mode in which a predetermined number of the driving pulses are included in the second driving waveform, and with a second print mode in which the number of the driving pulses included in the second driving waveform is less than the predetermined number; and when the second driving waveform is selected by the driving waveform selecting section with respect to a driving period, the driving waveform shifting section shifts the second driving waveform to a driving period which is two periods ahead of the driving period in the first print mode, and shifts the second driving waveform to a driving period which is one period ahead of the driving period in the second print mode.

* * * * *